US005326281A

United States Patent [19]

Yin

[11] Patent Number: 5,326,281

[45] Date of Patent: Jul. 5, 1994

[54] STRUCTURE FOR ELECTRO-MAGNETIC WAVE SHIELDING IN THE ELECTRIC PLUG USED IN TELECOMMUNICATION

[76] Inventor: Lin-Yen Yin, P.O. Box 80-20, Taipei Hsien, Taiwan

[21] Appl. No.: 12,381

[22] Filed: Feb. 2, 1993

[51] Int. Cl.[5] ..... H01R 13/648

[52] U.S. Cl. ..... 439/607; 439/610

[58] Field of Search ..... 439/607, 609, 610, 676, 439/901

[56] References Cited

U.S. PATENT DOCUMENTS

| | | | |
|---|---|---|---|
| 4,838,811 | 6/1989 | Nakamura et al. | 439/610 |
| 4,863,401 | 9/1989 | Talend | 439/610 |
| 4,981,447 | 1/1991 | Ichitsubo | 439/607 |
| 5,017,156 | 5/1991 | Sugiyama | 439/607 |
| 5,073,130 | 12/1991 | Nakamura | 439/607 |

*Primary Examiner*—Larry I. Schwartz

*Assistant Examiner*—Hien D. Vu

*Attorney, Agent, or Firm*—Pro-Techtor International

[57] ABSTRACT

An improved structure for electromagnetic wave shielding in an electric plug for telecommunication. The plug is composed of a main body molded from plastic and metallic shielding sheet. The main body has on each side a depressed side face with a central sliding groove and with a raised border near the end of the main body. The shielding sheet has two side sheet portions coinciding in length and size with the depressed side faces of the main body and having tenons at the front end thereof. The shielding sheet has at the rear top end thereof two protruding tabs. The shielding sheet and the main body are slidingly connected with each other. The protruding tabs are such that they can be fastened by machine. The shielded area of the plug of the present invention is enlarged relative to current technology.

3 Claims, 7 Drawing Sheets

STRUCTURE FOR ELECTRO-MAGNETIC WAVE SHIELDING IN THE ELECTRIC PLUG USED IN TELECOMMUNICATION

BACKGROUND OF THE INVENTION

The present invention relates to an improved structure in the electric plug used in telecommunication, and especially relates to a plug of which the electromagnetic wave shielding sheet can be automatically produced, and the shielding area against electromagnetic waves can be increased to provide better quality and reliability.

Communication instruments such as the computer, telephone, FAX machine, district network equipment etc. which take advantage of electronic communication all have plugs and sockets for telecommunication. Such instruments are generally provided with parts which include lug and socket for connecting with another plug provided on the end of a conductor. Such products can often be adversely affected in their function as well as the quality thereof by electromagnetic waves or static electricity, which can impede the transmission of information. A device is needed to prohibit electromagnetic waves as well as static electricity.

A plug for telecommunication equipment is generally ejection molded from plastic to form a main body. The outside periphery thereof is enveloped at an appropriated position with a shielding sheet material to perform the above mentioned function of prohibition of electromagnetic wave. Such shielding sheet normally is made of metallic material which can ground the electromagnetic wave and the static electricity, so as to eliminate the interference of electromagnetic wave or static electricity.

The primary defects of the existing plugs for telecommunication reside in that: the shielding area is too small; and the connection between the shielding sheet and the main body must be effected manually. We are now citing a drawing (FIG. 1) to illustrate the conventional structures:

Referring to FIG. 1, the conventional plug for telecommunication comprises a main body 10 molded integrally from plastic, a metal shielding sheet 11 envelops the outside periphery thereof. The shielding sheet 11 covers generally the rear half of the sides of the main body 10. The front ends of both sides of the shielding sheet 11 are provided with elongated connecting lugs 12 conforming in shape with that of both sides of the main body 10. Two short tongs 13, 14 are provided separately and are behind and at a slightly higher position of the lugs 12.

The short tongs 13, 14 extend vertically upward before the shielding sheet 11, 13 fixed on the main body 10. After the main body 10 and the shielding sheet 11 are joined, the tongs 13, 14 are bent down to a present position (as shown in FIG. 1). Such a structure has at least the following defects:

1. The tongs 13, 14 are very small, and are located in a narrow area. They are difficult to be put into place by a machine.

2. The tongs 13, 14 are conventionally manually bent down gradually from the vertical position. This is wasteful in labor cost.

3. Since the main connecting structure is operated by manual force, the quality thereof is difficult to control.

4. Due to the variations of the quality of the connection, the quality of the conventional structure is uneven.

It can be subjected to possible interference with communication transmitting, and the reliability is quite low.

Besides the above mentioned defects, the total shielding area is relatively small, thereby reducing its effectiveness.

SUMMARY OF THE INVENTION

The primary object of the present invention is to provide an improved device for an electromagnetic wave shielding sheet on a plug for telecommunication. The shielding sheet is bent to form a main bottom face and two sides sheet portions. The size of the sheet generally approximates that of the main body. There are tenons in the middle of the front ends of the side sheet portions. There are folded top sheet portions with two tabs extending forward and of suitable size and with two tabs extending downward. The tenons connect with grooves provided on both sides of the main body, and can snap inward to fit the shielding sheet in position at the end of the grooves. The forward extending top tabs of the shielding sheet are horizontal, and may be bent by machine to secure the shielding sheet to the main body. Therefore, an improved structure of the electromagnetic wave shielding sheet of an electric plug for telecommunication can be rapidly and automatically produced, giving the plug better assembly stability, more uniform quality, and greater reliability.

The novelty as well as other features of the device will be apparent in reading the detailed description and in referring to the accompanying drawings of the embodiments of the present invention.

BRIEF DESCRIPTION OF THE DRAWINGS

FIG. 3-1 is similar to FIG. 3, showing a variation of the present invention.

DETAILED DESCRIPTION OF THE PREFERRED EMBODIMENTS

Figure 1:
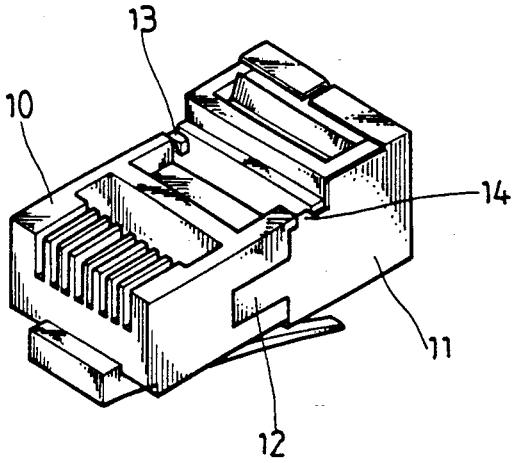
FIG. 1 (PRIOR ART)
FIG. 1 is a perspective view of a conventional plug for communication.
Figure 2:
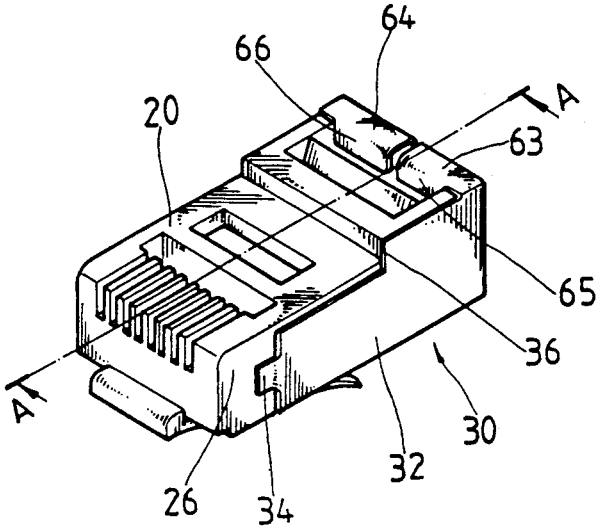
FIG. 2 is a perspective view of an embodiment of the present invention.
Figure 3:
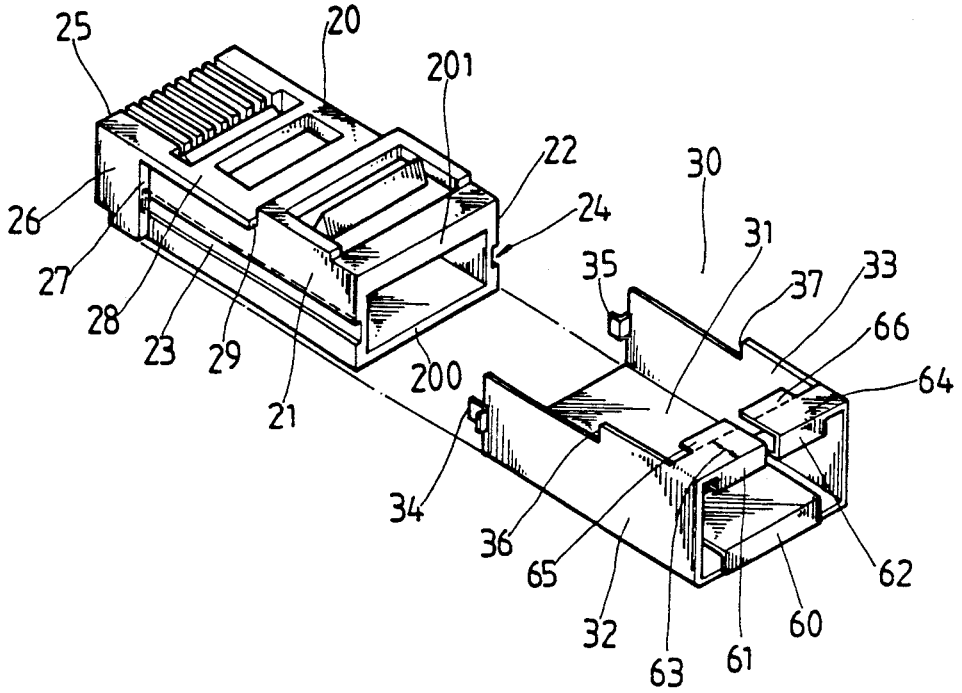
FIG. 3 is a view of the main body and shielding sheet of FIG. 2 separated from each other.
Figures 1, 3:
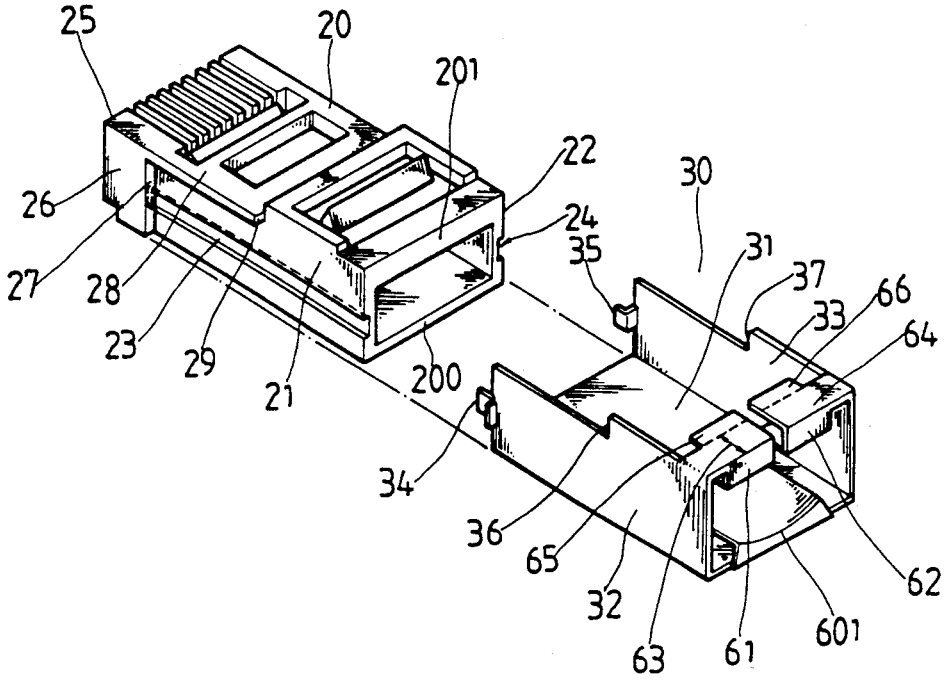

Referring to FIG. 2, the present invention is generally composed of a main body 20 which is injection molded from plastic, and a metallic shielding sheet 30. As shown in FIG. 3, the main body 20 has on both sides thereof depressed side faces 21, 22. In these side faces 21, 22 are grooves 23, 24. The side faces 21, 22 at a stepped border 27 near a front end face 25. A top surface 28 near the front end of the main body 20 protrudes out over the side faces 21, 22 to form two shoulders 29.

The shielding sheet 30 generally comprises a bottom 31, two side sheet portions 32, 33 provided at both sides of the bottom 31. The length of the side sheet portions 32, 33 is set to coincide with the length of the depressed side faces 21, 22. At the front of the sides 32, 33 there is a tenon 34, 35. The tenon 34, 35 is formed as an angled part which extends inward and then bends forward and is formed at the height of the sliding grooves 23, 24. Stop abutments 36, 37 is forward in the sides 32, 33 which mates with the abutting shoulders 29.

A lower inward folding sheet portion 60 with a gap thickness equal to that of a bottom plate 200 of the main body 20 extends from the shielding sheet 30 at the rear of the bottom 31. Similarly two upper folding sheet portions 63, 64 extend out from the shielding sheet 30 on the top of the sides 32, 33 and include two downward folded tabs 61, 62 with a gap thickness equal to that of the top plate 201 of the main body 20 extend from the upper folding sheet portions 63, 64. The upper folding sheet portions further have tabs 65, 66 of suitable size extending forward.

The shielding sheet 30 according to the above statement slides over the main body 20 for assembly. In the assembly process, the tenons 34, 35 are moved forward in the sliding grooves 23, 24. When the tenons 34, 35 slide over the stepped borders 27, the stop abutments 36, 37 are abutted against the shoulders 29 of the main body 20. The tenons 34, 35 snap inwardly due to the elastic recovery of the material of which they are made and thereby clamp the main body 20. At the same time, the clamping sheet portions comprising the lower inward folding sheet portion 60, the downward folded tabs 61, 62 and the upper folding sheet portions 63, 64 at the rear end of the shielding sheet 30 are fitted around the bottom plate 200 and the top late 201 respectively (as shown in FIGS. 3, 4).

Figure 4:
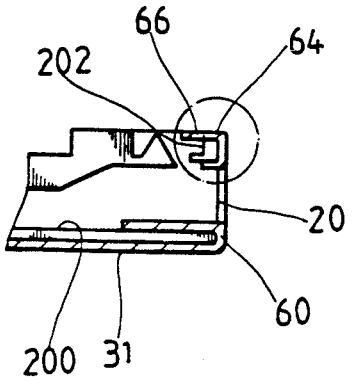
FIG. 4 is schematic sectional side view taken from line A—A of FIG. 2 showing how the components of FIG. 3 have been assembled.
Figure 5:
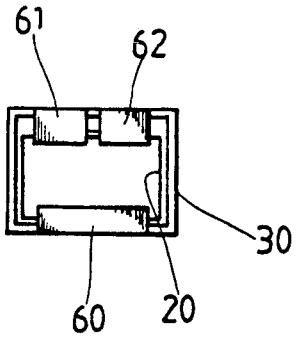
FIG. 5 is a rear view of FIG. 2 showing a flat downward folding sheet portion.
Figure 6:
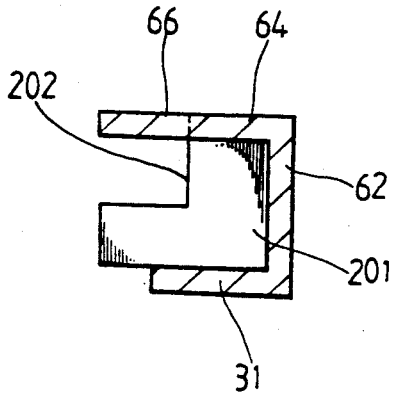
FIG. 6 is a partial enlarged view of FIG. 4.
Figure 7:
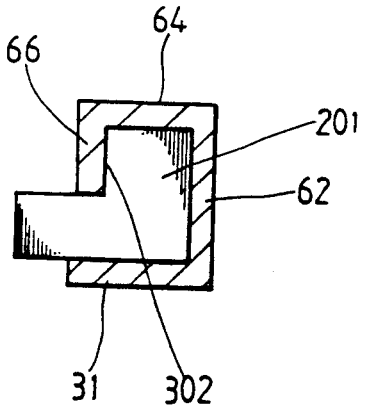
FIG. 7 is another partial enlarged view of FIG. 4, showing a tong that has been folded down.
Figure 8:
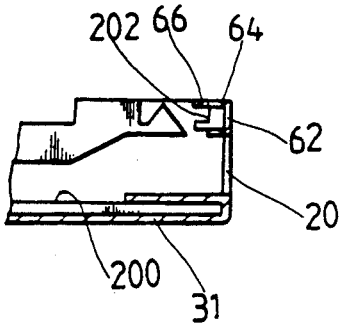
FIG. 8 is a side sectional view of another embodiment of the present invention similar to FIG. 4.
Figure 9:
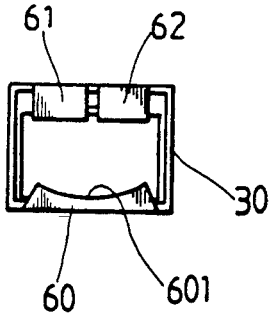
FIG. 9 is a rear view taken from FIG. 2 similar to FIG. 5 showing an arc shaped end view of the downward folding sheet portion as a variation of FIG. 5 and as shown in FIG. 3-1.

Please refer now to FIGS. 4, 6. When the shielding sheet 30 is joined with the main body 20, the tabs 65, 66 extending out of the upper folding sheet portions 63, 64 protrude over the top angled structure 202 of the main body 20 (FIG. 4). The tongs 65, 66 are of sufficient size, and are aligned on the relatively wide area of the top of the main body 20, so that they can be pressed down for connecting automatically by machine (FIG. 7). The shielding sheet 30 can thus be consistently assembled with the main body 20.

The embodiment stated above is used for a flat conductor. If an arc shaped conductor is used, the lower inward folding sheet portion 60 can be changed to have an arc shaped end 601 as shown in FIGS. 3-1 and 8, 9.

Due to the tabs 65, 66 being suitable for machine operation for bending during assembly, the present invention is therefore suited for automated production to increase the volume of production, and to reduce the labor cost. More importantly, the products will have more uniform quality and higher reliability. Other advantages include: when the shielding sheet 30 is assembled with the main body 20, the tabs 65, 66 and the tenons 34, 35 support the side sheet portions 32, 33. The assembled structure is therefore more stable.

Since the bottom and both sides of the structure, which may be subjected to electromagnetic waves, are almost entirely surrounded by the shielding sheet, the shielding area is thus greatly increased relative to the prior art. This of course can increase the ability of the present invention to prevent interference from electromagnetic waves 10.

Having described the present invention in detail, it is understood that the present invention can have other embodiments as well as varieties without departing from the spirit of the invention and the scope as stated in the claims.

I claim:

1. An electric plug with electromagnetic wave shielding used for telecommunication comprising:

a main body molded from plastic and a metallic shielding sheet; wherein each of two sides of said main body includes a groove located at the vertical center of a depressed side face and a stepped border near a front end thereof, and said shielding sheet includes two depressed side sheet portions of substantially the same size as the side faces of said main body, the side sheet portions further including a tenon at the height of the grooves in said main body;

said shielding sheet also including a lower inward folding sheet portion and a plurality of upper folding sheet portions situated at a rear end of said shielding sheet, the upper folding sheets including a plurality of tabs; wherein when said shielding sheet is slid onto said main body, said tabs are folded over said main body to secure the shielding sheet to said main body, the folding being accomplished by a machine operation.

2. The electric plug of claim 1 wherein;

each of said depressed side faces joins with a top face near a front end of said main body to form an abutting shoulder, the shoulders corresponding to stop abutments on said shielding sheet.

3. The electric plug of claim 1, wherein:

said tenons extend inward from the shielding sheet, then extent forward so as to form an angled portion.

* * * * *